US007315704B2

(12) United States Patent
Shin et al.

(10) Patent No.: US 7,315,704 B2
(45) Date of Patent: Jan. 1, 2008

(54) WET-TYPE IMAGE FORMING APPARATUS, A TONER CONCENTRATION SENSING METHOD, AND A METHOD FOR CONTROLLING WET-TYPE IMAGE FORMING APPARATUS

(75) Inventors: Joong-gwang Shin, Seongnam-si (KR); Shinichi Hisatomi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/246,375

(22) Filed: Oct. 11, 2005

(65) Prior Publication Data

US 2006/0078343 A1 Apr. 13, 2006

(30) Foreign Application Priority Data

Oct. 11, 2004 (KR) ..... 10-2004-0080968

(51) Int. Cl.
*G03G 15/10* (2006.01)

(52) U.S. Cl. ..... 399/57; 399/58

(58) Field of Classification Search ..... 399/57, 399/58

See application file for complete search history.

(56) References Cited

U.S. PATENT DOCUMENTS 4,370,053 A * 1/1983 Hirayama et al. ..... 399/60
5,623,715 A * 4/1997 Clark ..... 399/57
5,678,131 A * 10/1997 Alexandrovich et al. ..... 399/58
5,708,917 A * 1/1998 Kawai et al. ..... 399/58
6,466,749 B1 * 10/2002 O'Brien ..... 399/27
2005/0265738 A1 * 12/2005 Ogata ..... 399/27

FOREIGN PATENT DOCUMENTS

| | | |
|---|---|---|
| JP | 08-248760 | 9/1996 |
| JP | 09-034190 | 2/1997 |
| JP | 2003-186262 | 7/2003 |
| JP | 2003-270878 | 9/2003 |
| KR | 10-2003-0095022 A | 12/2003 |

* cited by examiner

*Primary Examiner*—David M. Gray
*Assistant Examiner*—Bryan Ready
(74) *Attorney, Agent, or Firm*—Roylance, Abrams, Berdo & Goodman, LLP

(57) ABSTRACT

A wet-type image forming apparatus and method is provided to sense and maintain a toner concentration level of a developer, and includes a counter for counting the number of dots of input print data, a memory for storing an average coverage of a print medium which corresponds to a predetermined dot number of the print data and storing a lookup table for consumption quantities of carrier and toner which correspond to the average coverage, and a control unit for calculating a toner concentration of a developer that remains in a developer supplying unit by recognizing consumption quantities of the carrier and the toner that are stored in the memory based on the counted dot number.

25 Claims, 9 Drawing Sheets

WET-TYPE IMAGE FORMING APPARATUS, A TONER CONCENTRATION SENSING METHOD, AND A METHOD FOR CONTROLLING WET-TYPE IMAGE FORMING APPARATUS

CROSS-REFERENCE TO RELATED APPLICATIONS

This application claims the benefit under 35 U.S.C. §119 (a) of Korean Patent Application No. 10-2004-0080968, filed in the Korean Intellectual Property Office on Oct. 11, 2004, the entire disclosure of which is incorporated herein by reference.

BACKGROUND OF THE INVENTION

1. Field of the Invention

The present invention relates to a wet-type image forming apparatus. More particularly, the present invention relates to a wet-type image forming apparatus, a method for sensing the concentration of a toner, and a method for controlling the wet-type image forming apparatus.

2. Description of the Related Art

Generally, image forming apparatuses are divided into monochromatic image forming apparatuses and color image forming apparatuses. Monochromatic image forming apparatuses form images in black and white by using only a one-color developer, while color image forming apparatuses form colorful images by using developers of various colors such as magenta, cyan, yellow, and black.

As well known to those skilled in the art, an electrophotographic image forming apparatus forms an electrostatic latent image on an organic photoconductor that is charged by a charging unit to a predetermined potential with a laser beam emitted from a laser scanning unit. The electrostatic latent image is developed with a developer and transferred into a visible image on paper. In a color image forming apparatus, the organic photoconductor of each color is developed with developers of each color, and then the developed images are overlapped and transferred to an intermediate transfer medium such as an intermediate transfer belt (ITB). A color image obtained by overlapping images of each color on the intermediate transfer medium is then transferred onto printing paper. The printing paper containing the color image goes through a series of fixing processes and is then ejected out of the image forming apparatus.

Herein, the developer is comprised of ink prepared by mixing a powder-type toner having a predetermined color, and a liquid carrier. The developer is accommodated in and supplied from a separate developer cartridge which is mounted on the image forming apparatus. The developer contained in the developer cartridge is maintained to have a predetermined reference concentration of toner with respect to carrier, and which is set in the image forming apparatus. However, the concentration of the toner can be outside of the reference concentration value while the developer is consumed due to a printing environment factor and/or an error in data. In this case, it is hard to acquire an image of a desired color and concentration.

Accordingly, a system and method is needed to sense and maintain the concentration of the toner in the cartridges at a uniform level.

SUMMARY OF THE INVENTION

It is, therefore, an object of the present invention to substantially solve the above and other problems, and provide a wet-type image forming apparatus that can sense the concentration of a toner in a simple manner.

It is another object of the present invention to provide a method for sensing a toner concentration of a developer in a simple manner.

It is yet another object of the present invention to provide a method for controlling an image forming apparatus to maintain the toner concentration uniformly in a simple manner.

In order to achieve the first and other objects in accordance with an aspect of the present invention, a wet-type image forming apparatus is provided which comprises a counter for counting the number of dots of input print data, a memory for storing an average coverage of a print medium which corresponds to a predetermined dot number of the print data and for storing a lookup table for consumption quantities of carrier and toner which correspond to the average coverage, and a control unit for calculating a toner concentration of a developer that remains in a developer supplying unit by recognizing consumption quantities of the carrier and the toner that are stored in the memory based on the counted dot number.

Herein, the memory stores a reference toner concentration for comparison with the toner concentration calculated by the control unit.

The wet-type image forming apparatus further comprises a developer for developing the input print data and a transferring unit for receiving an image formed in the developing unit, wherein the control unit compares the calculated toner concentration with the reference toner concentration and controls the developing unit and/or the transferring unit to selectively consume the carrier or the toner based on the comparison result.

The developing unit comprises an organic photoconductor on which an image is formed, a laser scanning unit for forming an electrostatic latent image by scanning the organic photoconductor with a laser beam, the laser scanning unit being selectively driven by the control unit, a developing member which selectively receives a voltage from the control unit and supplies the developer to the organic photoconductor when the developing member receives the voltage, and a developer supplying member which selectively receives a voltage from the control unit and supplies the developer to the developing member when receiving the voltage.

The control unit lowers the toner concentration of the developer supplying unit by controlling the operation of the laser scanning unit and controlling the voltage supply to the developing member and the developer supplying member.

The transferring unit comprises an intermediate transfer medium for receiving the image formed in the developing unit and a transfer roller which supports the intermediate transfer medium and transfers the image of the developing unit to the intermediate transfer medium when the transfer roller receives a predetermined voltage.

To achieve the second and other objects of the present invention, in accordance with another aspect of the present invention, a method is provided for sensing a concentration of toner in a wet-type image forming apparatus which comprises the steps of a) acquiring consumption quantities of toner and carrier based on input print data, and b) calculating a toner concentration of a remaining developer based on the consumption quantities of the toner and the carrier.

Herein, the step a) comprises the steps of a1) preparing a lookup table for an average coverage corresponding to a predetermined number of dots and the consumption quantities of the toner and the carrier corresponding to the average coverage, a2) counting the number of dots of the input print data, and a3) recognizing the consumption quantities of the toner and the carrier corresponding to the counted dot number based on the stored lookup table.

The step a) further comprises a step of a4) upgrading data of the lookup table based on the input print data.

The step a4) comprises the steps of a4-1) accumulating the consumption quantities of the toner and the carrier recognized in each printing operation, and a4-2) storing the accumulated consumption quantities of the toner and the carrier in a memory.

To achieve the third and other objects of the present invention, in accordance with another aspect of the present invention, a method is provided for controlling a wet-type image forming apparatus which comprises the steps of a) sensing toner concentration of a developer based on the number of dots of input print data, b) comparing the sensed toner concentration with a reference toner concentration, and c) controlling the sensed toner concentration to maintain a level substantially equal to the reference toner concentration based on the comparison result.

Herein, the step a) comprises the steps of a1) acquiring consumption quantities of toner and carrier based on the number of dots of input print data, and a2) calculating the toner concentration of a remaining developer based on the consumption quantities of the toner and the carrier.

The step a1) comprises the steps of a1-1) preparing a lookup table for an average coverage corresponding to a predetermined number of dots and the consumption quantities of the toner and the carrier corresponding to the average coverage, a1-2) counting the number of dots of the input print data, and a1-3) recognizing the consumption quantities of the toner and the carrier corresponding to the counted dot number based on the stored lookup table.

The step a1) further comprises a step of a1-4) upgrading data of the lookup table based on the input print data.

The step a1-4) comprises the steps of a1-41) accumulating the consumption quantities of the toner and the carrier recognized in each printing operation, and a1-42) storing the accumulated consumption quantities of the toner and the carrier in a memory.

The step c) comprises a step of c1) wherein if the sensed toner concentration is higher than the reference toner concentration, lowering the toner concentration by consuming the toner.

The step c1) comprises the steps of c1-1) forming an image for selectively consuming the toner on an organic photoconductor, c1-2) transferring the image for consuming the toner to a transferring unit, and c1-3) removing the image for consuming the toner which is transferred to the transferring unit through cleaning.

The step c1-1) comprises the steps of c1-11) calculating a quantity of the toner to be consumed, c1-12) driving a driving motor, c1-13) forming an electrostatic latent image on the organic photoconductor to correspond to the calculated toner quantity by driving a laser scanning unit, and c1-14) developing the toner in the electrostatic latent image area by supplying predetermined voltages to a developer supplying member and a developing member for a predetermined time.

The quantity of the toner to be consumed is acquired from a lookup table which is pre-established through experiments.

The transferring unit comprises an intermediate transfer medium and a T1 roller which supports the intermediate transfer medium at a side opposite to the organic photoconductor.

The step c1-2) then comprises the steps of c1-21) running and driving the intermediate transfer medium, and c1-22) supplying a predetermined voltage to the T1 roller for a predetermined time.

The image for consuming the toner is formed in a predetermined pattern to further serve to correct color and/or registration.

The step c) further comprises a step of c2) wherein if the sensed toner concentration is lower than the reference toner concentration, raising the toner concentration by consuming the carrier.

The step c2) comprises the steps of c2-1) selectively supplying the carrier to the surface of the organic photoconductor, c2-2) transferring the carrier supplied to the organic photoconductor to a transferring unit, and c2-3) removing the carrier transferred to the transferring unit through cleaning.

The step c2-1) comprises the steps of c2-11) calculating a quantity of the carrier to be consumed, c2-12) driving the driving motor of the developing unit, and c2-13) transferring the carrier to the organic photoconductor by supplying a predetermined voltage to the developer supplying member and the developing member.

The supply quantity of the carrier is adjusted by controlling the power and supply time of the voltage selectively supplied to the individual developer supplying member and the developing member in the step c2-13.

The transferring unit comprises an intermediate transfer medium running in contact with the organic photoconductor and comprises a T1 roller supporting the intermediate transfer medium at a side opposite to the organic photoconductor.

The step c2-2) then comprises the steps of c2-21) running and driving the intermediate transfer medium, and c2-22) transferring only the carrier on the surface of the organic photoconductor to the intermediate transfer medium by suspending the voltage supply to the T1 roller.

The step c) is carried out in at least any one step of a warming-up mode, a printing mode, and a transferring unit cleaning mode after the printing mode.

BRIEF DESCRIPTION OF THE DRAWINGS

The above and other aspects and features of the present invention will become more apparent by describing exemplary embodiments of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Exemplary embodiments of the present invention will now be described in greater detail with reference to the accompanying drawings.

The matters defined in the description, such as detailed construction and element descriptions, are provided to assist in a comprehensive understanding of the invention. Also, functions or constructions that are well known to those skilled in the art are not described in detail for clarity and conciseness.

Hereinafter, a wet-type image forming apparatus, a method for sensing a toner concentration, and a method for controlling the wet-type image forming apparatus using the same will be described in accordance with exemplary embodiments of the present invention with reference to the accompanying drawings.

Figure 1:
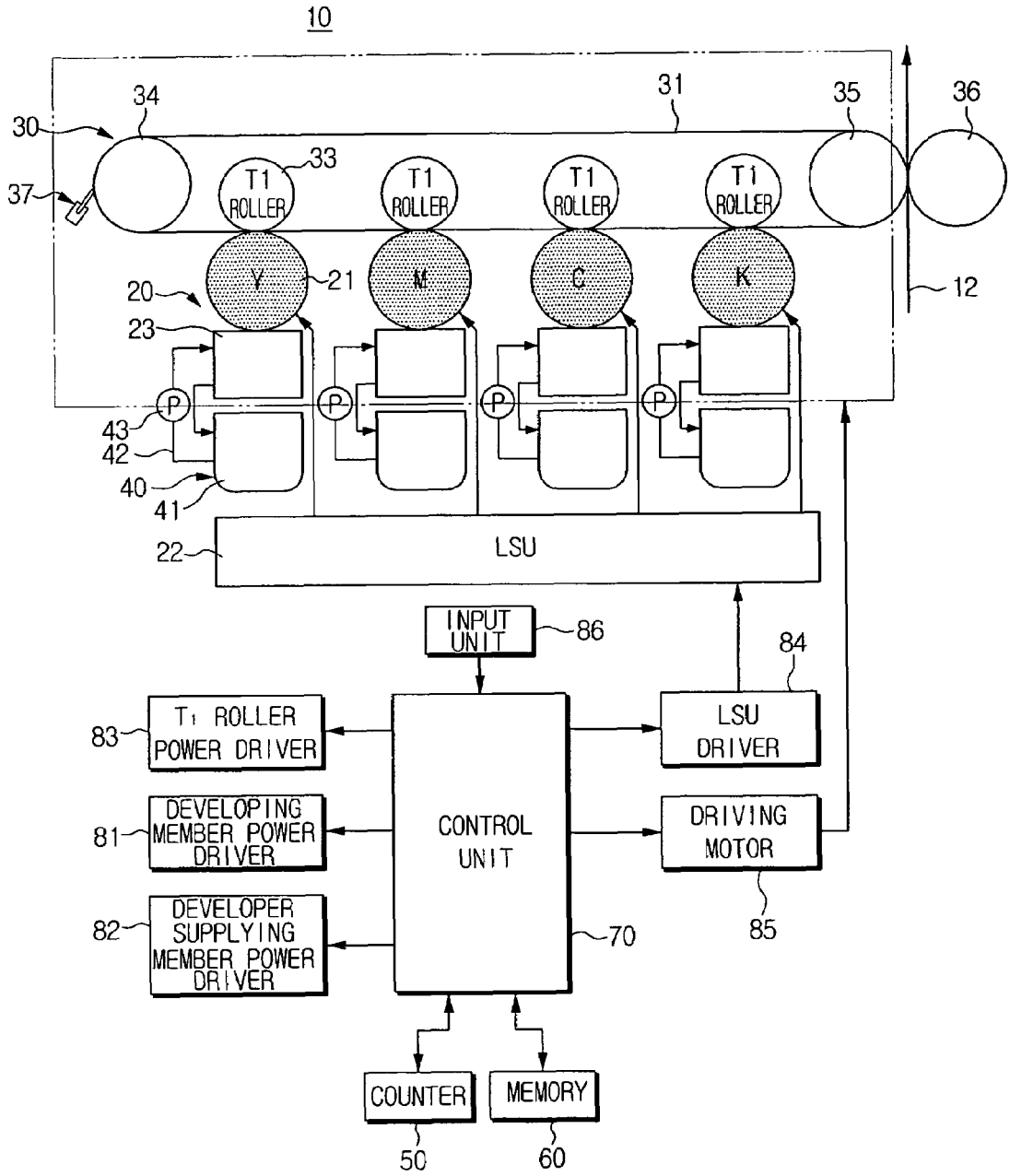
FIG. 1 is a block diagram illustrating a wet-type image forming apparatus in accordance with an embodiment of the present invention.

A wet-type image forming apparatus 10 suggested in embodiments of the present invention will be described by taking a color image forming apparatus as an example. As illustrated in FIG. 1, which is a block diagram illustrating a wet-type image forming apparatus 10 in accordance with an embodiment of the present invention, the image forming apparatus 10 comprises a developing unit 20 for forming an image, a transferring unit 30 for receiving the image transferred from the developing unit 20, a developer supplying unit 40 for supplying a developer to the developing unit 20, a counter 50 for counting the number of dots of input print data, a memory 60 for storing a predetermined lookup table, and a control unit 70. Herein, the developer is comprised of ink formed by mixing powder-type toner having a predetermined color with a liquid carrier in a predetermined ratio.

The developing unit 20 comprises organic photoconductors 21 for yellow (Y), magenta (M), cyan (C), and black (K) colors, a laser scanning unit (LSU) 22 for forming a predetermined electrostatic latent image by scanning the organic photoconductors 21 with a laser beam, and a developing portion 23 for forming a desired image by supplying the developer to the electrostatic latent image.

The laser scanning unit 22 is driven by a laser scanning unit (LSU) driver 84, which is selectively controlled by the control unit 70, and scans the organic photoconductors 21 with the laser beam.

Figure 2:
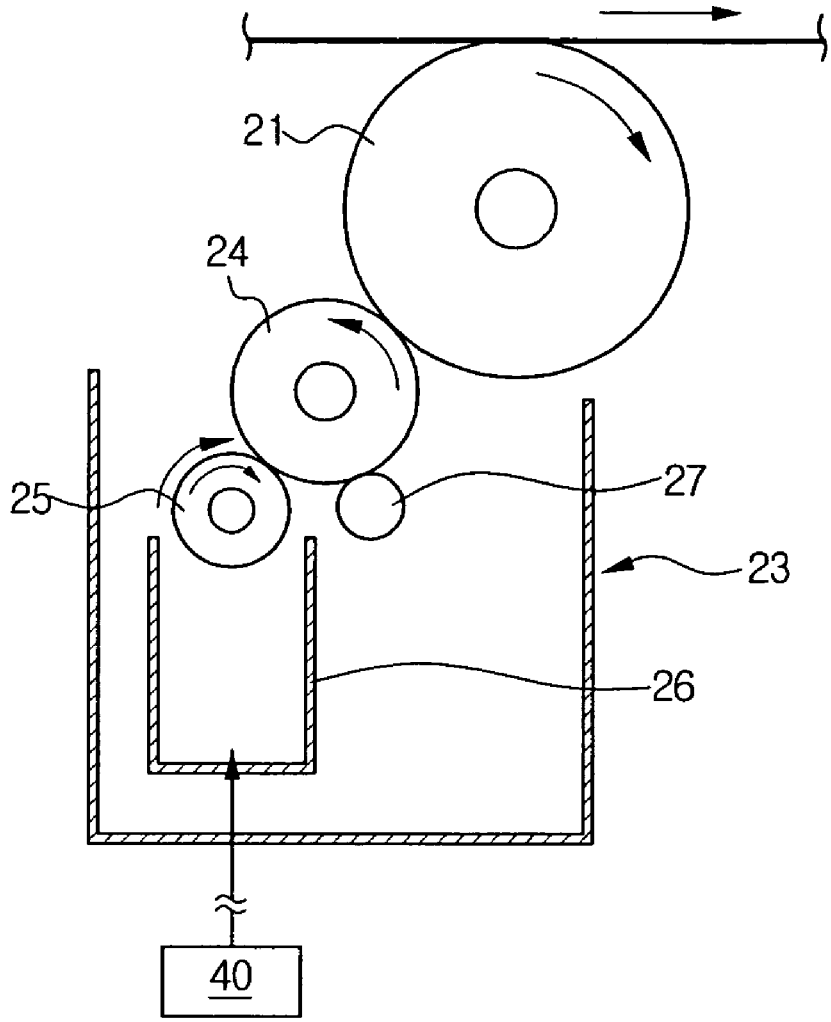
FIG. 2 is a diagram illustrating a developing unit of FIG. 1 in accordance with an embodiment of the present invention.

The developing portion 23 receives the developer from the developer supplying unit 40 and supplies it to the organic photoconductors 21. As illustrated in FIG. 2, which is a diagram illustrating a developing unit 20 of FIG. 1, the developing portion 23 comprises a developing member 24 for supplying the developer to the electrostatic latent image area of the organic photoconductors 21, and a developer supplying member 25 for supplying the developer to the developing member 24.

The developing member 24 receives a predetermined voltage from a developing member power driver 81 which is controlled by the controller 70. Therefore, when the voltage is applied to the developing member 24, the toner in the developer is transferred from the surface of the developing member 24 to the electrostatic latent images of the organic photoconductors 21. The quantity of the toner transferred to the organic photoconductors 21 is adjusted according to the level of the voltage supplied to the developing member 24.

If the organic photoconductors 21 do not have the electrostatic latent images formed thereon, the toner is not transferred, even though the voltage is supplied to the developing member 24. Instead, only a predetermined quantity of carrier of the developer is transferred to the organic photoconductors 21. The quantity of the transferred carrier depends on the level of the voltage supplied to the developing member 24.

The developer supplying member 25 receives a voltage from a developer supplying member power driver 82 which is controlled by the control unit 70. The developer supplying member 25 supplies the developer in a developing chamber 26 to adhere to the surface of the developing member 24 when the voltage is supplied. The quantity of the developer supplied to the developing member 24 can be adjusted depending on the level of the voltage supplied to the developer supplying member 25. Further, the developer transferred to the developing member 24 by the developer supplying member 25 and the thickness of the developer is controlled by a developer layer controlling unit 27.

The transferring unit 30 comprises an intermediate transfer medium 31 which is rotated in contact with the organic photoconductors 21 and comprises transfer rollers 33, which will be referred to as T1 rollers hereinafter, formed to contact the organic photoconductors 21 with the intermediate transfer medium 31.

The intermediate transfer medium 31 is supported by a driving roller 34 and a support roller 35 and runs on an infinite track.

The T1 rollers 33 receive a voltage from a T1 roller power driver 83 which is controlled by the control unit 70. An image formed on the organic photoconductors 21 is transferred onto the intermediate transfer medium 31 by the voltage supplied to the T1 rollers 33. The image transferred onto the intermediate transfer medium 31 is then transferred onto paper 12 that passes through and between a T2 roller 36 and the intermediate transfer medium 31.

The toner or carrier that remains on the intermediate transfer medium 31 is removed by a cleaning unit 37 through cleaning. The cleaning unit 37 is set up to selectively contact the intermediate transfer medium 31. Therefore, the cleaning unit 37 contacts the intermediate transfer medium 31 and performs cleaning operations when required, and is moved from the intermediate transfer medium 31 at other times. When the cleaning unit 37 performs cleaning on the intermediate transfer medium 31, the T2 roller 36 can be moved from the intermediate transfer medium 31 in a similar manner.

The developer supplying unit 40 comprises a cartridge 41 for accommodating the developer, a developer supply path 42, and a developer supply pump 43. The cartridge 41 can be detachably set up in the image forming apparatus 10 as it is consumable goods that must be replaced when the developer accommodated therein is completely consumed.

Thus, a new cartridge 41 contains a predetermined quantity of the developer, and the toner concentration of the developer has an appropriate standard with respect to an image.

Herein, the developing unit 20 and the transferring unit 30 are driven simultaneously by a driving motor 85 which is controlled by the control unit 70. It is also possible to drive the developing unit 20 and the transferring unit 30 separately and/or individually with an additional driving motor (not shown).

The counter 50 counts the number of dots for print data input from an input unit 86.

Figure 3:
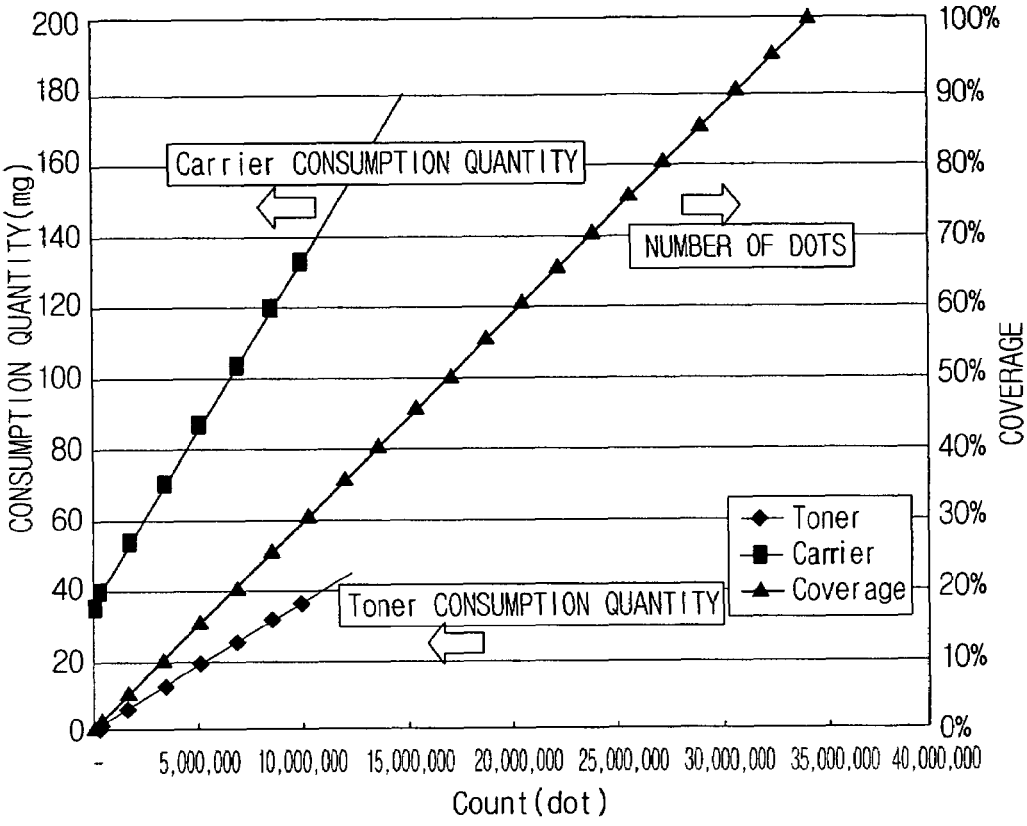
FIG. 3 is a graph illustrating a lookup table stored in a memory of FIG. 1 in accordance with an embodiment of the present invention.
Figure 4:
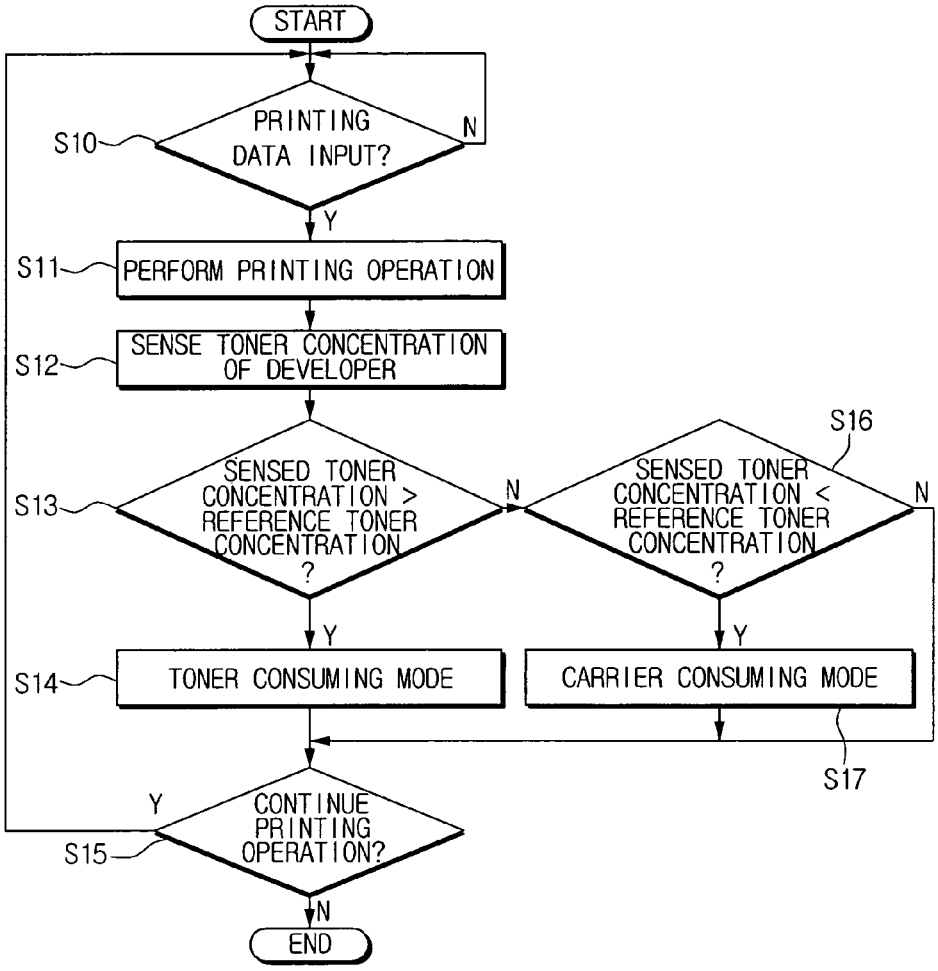
FIG. 4 is a flowchart illustrating a method for controlling a wet-type image forming apparatus in accordance with an embodiment of the present invention.

The memory 60 stores an average coverage of a print medium that correspond to a predetermined number of dots for printing, and stores a lookup table (LUT) for consumption quantities of the toner and carrier that correspond to the average coverage. FIG. 3 is a graph illustrating a lookup table stored in a memory of FIG. 1 in accordance with an embodiment of the present invention. That is, as illustrated in FIG. 3, the memory 60 stores data for the average coverage that corresponds to a predetermined number of dots through predetermined experiments. Consumption Quantity is shown along the left-most Y axis of the plot of FIG. 3, percent coverage is shown along the right-most Y axis, and dot count is shown along the X axis. Three plots are shown by way of example in FIG. 3 to illustrate (1) carrier consumption quantity per dot count, (2) toner consumption per dot count, and (3) percent coverage per dot count. Accordingly, as described in greater detail below, the LUT of FIG. 3 can be used in steps S12 of FIG. 4, steps S21 and S22 of FIG. 5, step S30 of FIG. 6, and step S41 of FIG. 8. Also stored in the memory 60 are data for average consumption quantities of the toner and the carrier corresponding to each average coverage.

The control unit 70 receives the counted dot number from the counter 50 and calculates an average coverage corresponding to the counted dot number based on the lookup table stored in the memory 60. The control unit 70 also calculates the consumption quantities of the toner and the carrier corresponding to the calculated average coverage. The control unit 70 can then calculate the toner concentration of the developer that remains in the developer supplying unit 40 based on the calculated consumption quantities of the toner and carrier. The control unit 70 can sense the concentration of the toner of the developer whenever the printing operation is performed by accumulating and storing the dot number of each printing operation in the memory 60 to maintain current information.

As described above, a wet-type image forming apparatus which is suggested in exemplary embodiments of the present invention, can sense the toner concentration of the remaining developer by using the number of dots of input print data without a concentration sensor. Therefore, embodiments of the present invention can reduce the production cost by reducing the number of parts, and prevent errors caused by problems or malfunctions of parts.

In addition, the control unit 70 can compare the sensed toner concentration with a reference toner concentration stored in the memory 60 after it senses the concentration of the developer. The control unit 70 can then maintain the concentration of the remaining toner at a level substantially equal to the reference level by controlling the developing unit 20 and the transferring unit 30 to selectively consume the toner and carrier according to the comparison result.

Hereinafter, a method for controlling a wet-type image forming apparatus will be described in greater detail in accordance with embodiments of the present invention.

Referring to FIGS. 1 to 4, at step S10, the control unit 70 is in a state waiting for printing and checks whether print data is input from the input unit 86. If the control unit 70 confirms the input of print data at step S10, it performs a printing operation at step S11. The printing operation is carried out through a known developing process.

At step S12, the control unit 70 senses the number of dots of the input print data and the toner concentration of the developer which remains in the developer supplying unit 40 based on the data stored in the memory 60.

At step S13, the control unit 70 compares the sensed toner concentration with the reference toner concentration stored in the memory 60, and determines whether the sensed toner concentration is higher than the reference toner concentration.

If the sensed toner concentration is higher than the reference toner concentration, the control unit 70 goes into a toner consuming mode at step S14. In step S14, the control unit 70 maintains the toner concentration of the developer that remains in the developer supplying unit 40 at a level substantially equal to the reference toner concentration by consuming the surplus toner.

Herein, when the toner consuming mode is ended at step S14, the control unit 70 determines whether to continue the printing operation at step S15, and ends or continues the printing operation.

If the toner concentration sensed at step S13 is not higher than the reference toner concentration, it is determined at step S16 whether the sensed toner concentration is lower than the reference toner concentration. If it is determined that the sensed toner concentration is lower than the reference toner concentration at step S16, the control unit 70 carries out a carrier consuming mode at step S17. At step S17, the toner concentration of the developer that remains in the developer supplying unit 40 can be maintained at a level substantially equal to the reference toner concentration by consuming the surplus carrier at step S17. Subsequently, at step S15 it is determined whether to end or continue the printing operation.

Figure 5:
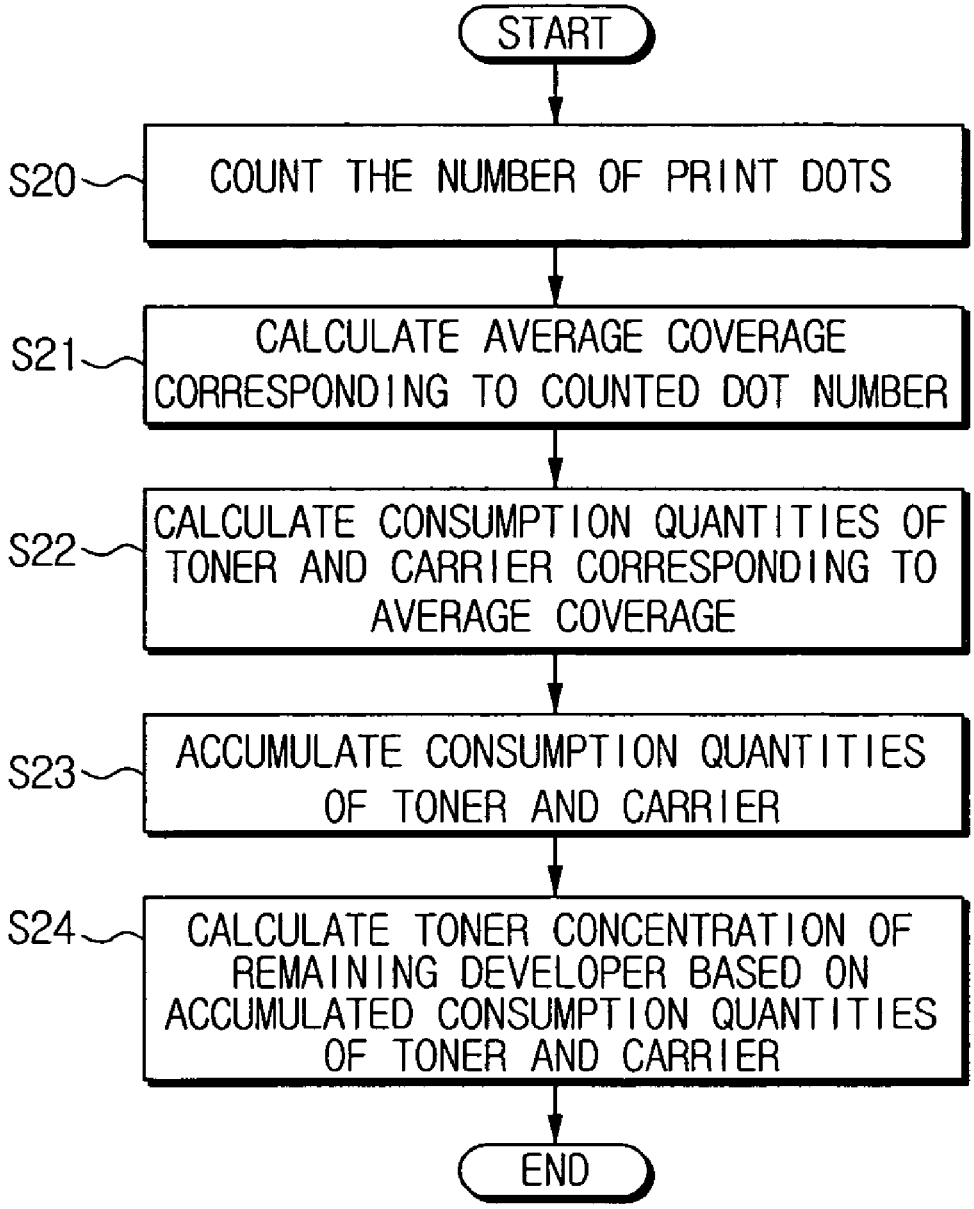
FIG. 5 is a flowchart illustrating a method for sensing a toner concentration of a developer in FIG. 4 in accordance with an embodiment of the present invention.

Referring to FIG. 5, the process of sensing the toner concentration at step S12 is described in detail. At step S20, the number of print dots of input print data is counted in the counter 50. At step S21, the control unit 70 calculates an average coverage corresponding to the counted dot number based on the lookup table stored in the memory 60. Then, at step S22, the control unit 70 calculates the consumption quantities of the toner and the carrier corresponding to the calculated average coverage based on the lookup table stored in the memory 60. At step S23, the control unit 70 accumulates the consumption quantities of the toner and the carrier which are calculated in each printing operation and stores them in the memory 60. Finally, at step S24, the control unit 70 calculates the toner concentration of the developer that remains in the developer supplying unit 40 based on the total consumption quantities of the toner and the carrier.

Figure 6:
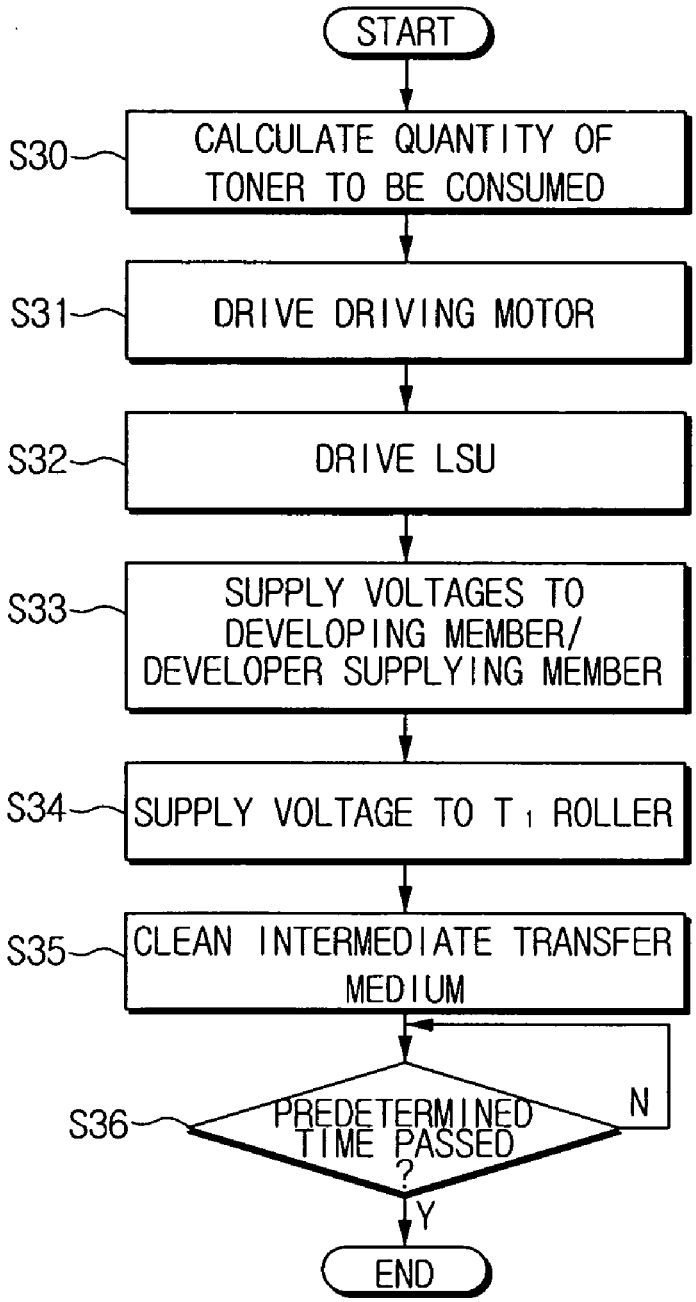
FIG. 6 is a flowchart illustrating a toner consuming step of FIG. 4 in detail in accordance with an embodiment of the present invention.
Figure 7:
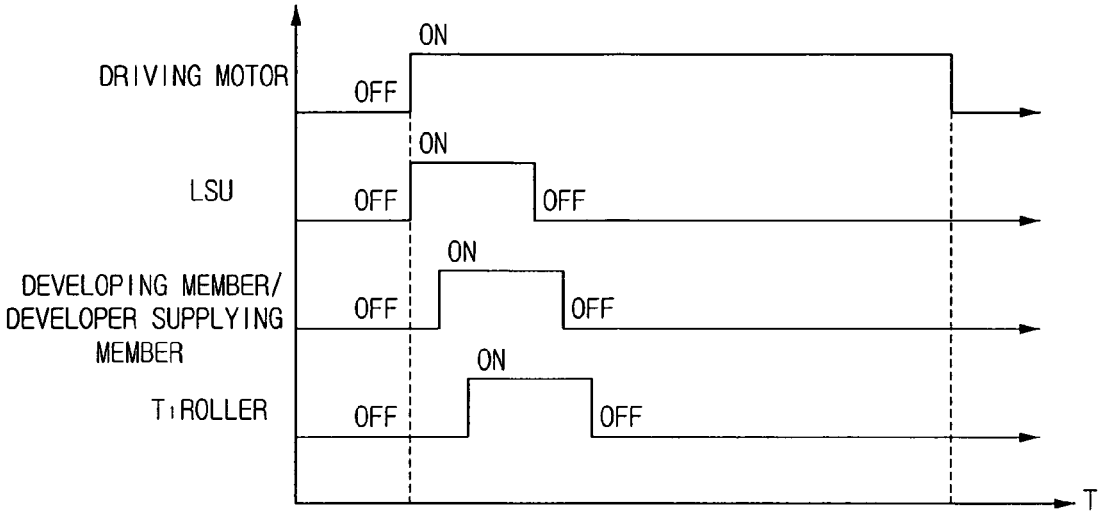
FIG. 7 is a diagram illustrating an operation of the image forming apparatus in accordance with the flowchart of FIG. 6.

Referring to FIGS. 6 and 7, the toner consuming mode operation at step S14 will now be described in detail.

First, at step S30, the control unit 70 calculates the quantity of the toner to be consumed. That is, the control unit 70 calculates how much toner should be consumed to make the sensed toner concentration reach a level substantially equal to the reference toner concentration, and acquires an average coverage corresponding to the calculated toner consumption quantity. Then, the control unit 70 acquires the number of print dots that corresponds to the average coverage based on the lookup table of the memory 60 to thereby acquire the number of print dots for consuming the toner. At step S31, the control unit 70 drives the driving motor 85 based on the data obtained above to thereby drive the developing unit 20 and the transferring unit 30. Subsequently, at step S32, the control unit 70 controls the laser scanning unit (LSU) driver 84 to scan the organic photoconductor 21 with a laser beam for a predetermined time to thereby form an electrostatic latent image on the organic photoconductors 21.

At step S33, the control unit 70 controls the developing member power driver 81 and the developer supplying member power driver 82 to supply predetermined voltages to the developing member 24 and the developer supplying member 25, respectively. Then, the developer is attached to the developing member 24, and the toner of the developer that is transferred to the developing member 24 is transferred to the electrostatic latent image area of the organic photoconductor 21.

Subsequently, at step S34, the control unit 70 drives and controls the T1 roller power driver 83 to supply a predetermined voltage to the T1 rollers 33. Then, the toner transferred to the electrostatic latent image area of the organic photoconductors 21 is transferred to the intermediate transfer medium 31. At step S35, the toner transferred to the intermediate transfer medium 31 is removed by being cleaned from the intermediate transfer medium 31 by the cleaning unit 37. Herein, the intermediate transfer medium 31 and the T2 roller 36 are driven and controlled at step S35 to be apart from each other with a space therebetween. Since the operation time for steps 30 to 35 is determined based on the quantity of the toner to be consumed, the control unit 70 ends the toner consuming mode after a predetermined time is passed at step S36.

Also, the sizes of the voltages supplied to the developing member 24 and the developer supplying member 25 at step S33 can be selectively controlled based on the quantity of the toner to be consumed. The operation time of the toner consuming mode at step S14 can be predetermined and controlled based on the quantity of the toner to be consumed.

Preferably, an image for consuming the toner in the organic photoconductor 21 can be formed in a predetermined pattern to correct color and/or registration. In this case, there is an advantage in that color and/or registration can be corrected, as well as consuming the toner.

Also, the toner consumption at step S14 can be carried out simultaneously when the intermediate transfer medium 31 is cleaned after the end of the printing operation. It is also possible to selectively perform the toner consumption of step S14 in a warming up step before the printing operation, or in the middle of the printing operation. That is, the step S14 can be carried out by being selectively added to any step of the printing process.

Figure 8:
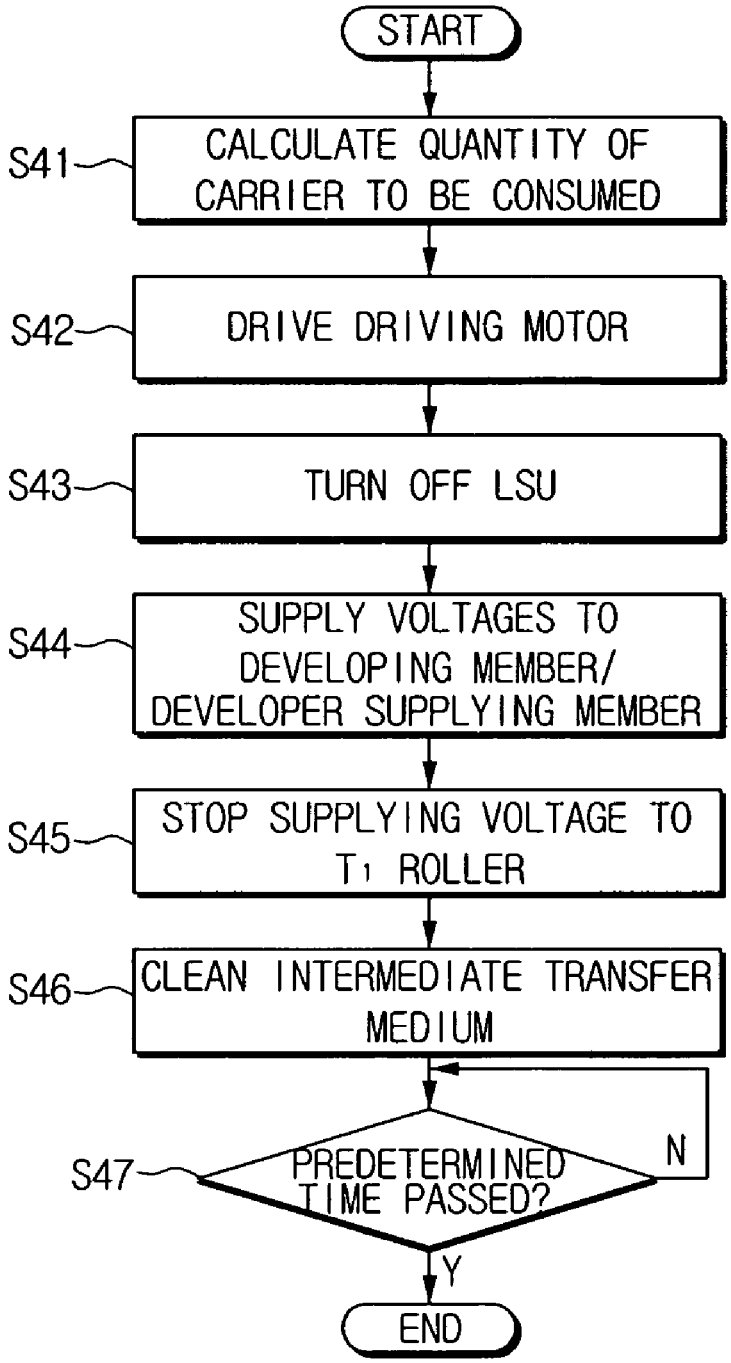
FIG. 8 is a flowchart illustrating a carrier consuming step of FIG. 4 in detail in accordance with an embodiment of the present invention.
Figure 9:
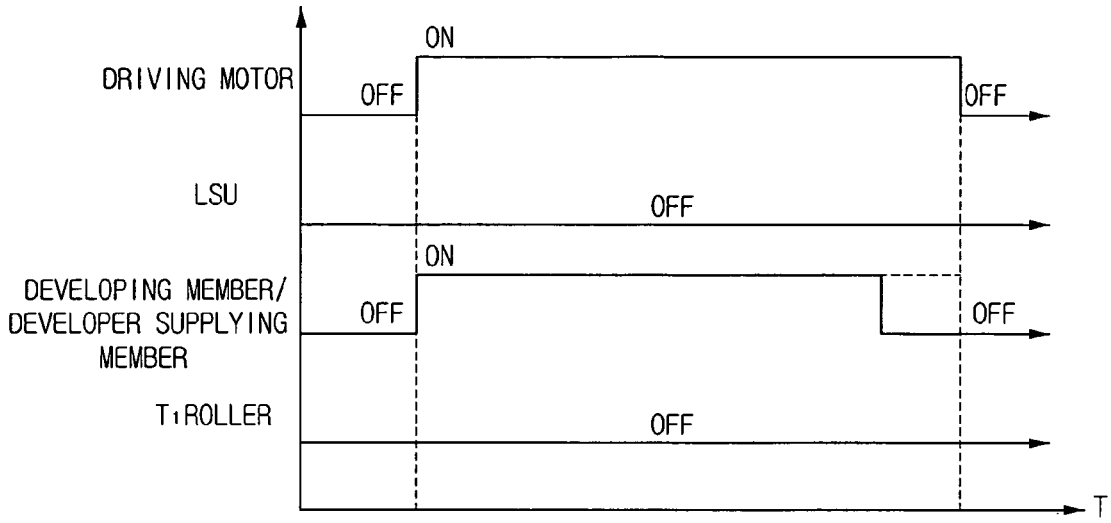
FIG. 9 is a diagram illustrating an operation of the image forming apparatus in accordance with the flowchart of FIG. 8.

Referring to FIGS. 8 and 9, the carrier consumption at step S17 will now be described in detail.

First, at step S41, the control unit 70 calculates the quantity of the carrier to be consumed to make the sensed toner concentration reach a level substantially equal to the reference toner concentration. At step S42, the control unit 70 drives the driving motor 85 to operate the developing unit 20 and the transferring unit 30. Subsequently, at step S43, the control unit 70 turns off the LSU driver 84 so as to prevent scanning of the surface of the organic photoconductor 21 with the laser beam.

At step S44, the control unit 70 drives the driving motor and, simultaneously, controls the developing member power driver 81 and the developer supplying member power driver 82 to supply predetermined voltages to the developing member 24 and the developer supplying member 25, respectively. The developer is then transferred onto the surface of the developing member 24 by the developer supplying member 25, and the developer of the developing member 24 is transferred to the organic photoconductor 21 in a predetermined thickness. Herein, since the organic photoconductor 21 is not exposed to the laser beam, the toner of the developer on the surface of the developing member 24 remains on the developing member 24 and only a predetermined quantity of the carrier is attached to the organic photoconductor 21. At step S45, the control unit 70 continues to suspend the supply of a voltage to the T1 rollers 33. Then, the predetermined quantity of the carrier on the organic photoconductors 21 is transferred to the intermediate transfer medium 31 by the contact between the organic photoconductor 21 and the intermediate transfer medium 31. At step S46, the intermediate transfer medium 31 is cleaned by the cleaning unit 37 and thus, only the predetermined quantity of the carrier is consumed. As in the toner consuming mode, the intermediate transfer medium 31 and the T2 roller 36 are positioned apart from each other to allow removal of the carrier transferred to the intermediate transfer medium 31 by the cleaning unit 37. Since means and methods for the separation of the intermediate transfer medium 31 and the T2 roller 36 are well known by those skilled in the art, detailed descriptions of each will not be provided herein.

The calculated quantity of the carrier to be consumed is controlled by establishing the driving motor operation time and establishing the sizes and supply times of the voltages supplied to the developing member 24 and the developer supplying unit 25. Therefore, at step S47, the control unit 70 determines whether the established time is passed and, after the established time is passed, it ends the carrier consuming mode. That is, the driving motor 84 is suspended and the voltage supply to the developing member 24 and the developer supplying unit 25 is suspended.

As described above, the carrier consumption of step S17 in which the surplus carrier is removed, can be selectively controlled to be carried out in the cleaning step of the intermediate transfer medium 31 after the printing operation, in the warming up step before the printing operation, or in the middle of the printing operation, just as with the toner consumption process of step S14.

Also, the toner concentration sensing of step S12 can be carried out for each color developer supplying unit. That is, the dot number for each color of the input color print data is counted. The toner concentration of a developer of each color is then sensed based on the counted dot number of each color.

The toner concentration of the developer for each color can be controlled to maintain a level substantially equal to the reference toner concentration by comparing the sensed toner concentration of each color with the reference toner concentration. The process of controlling the toner concentration of the developer for each color to maintain a level substantially equal to the reference toner concentration is carried out in substantially the same method as described with reference to FIGS. 5 to 9.

As described above, a wet-type image forming apparatus, toner concentration sensing method, and method for controlling a wet-type image forming apparatus according to embodiments of the present invention can sense the toner concentration of the remaining developer based on input print data without a separate sensor.

Therefore, it is possible to improve productivity while reducing the production cost by reducing the number of parts. Also, it is possible to prevent problems caused by errors, malfunctions, or other difficulties that can be generated when a separate sensor is used.

In addition, since the toner and/or the carrier is selectively consumed based on the sensing result, the toner concentration can be maintained uniformly. Therefore, images are prevented from being degraded, which improves reliability of the product.

The foregoing embodiments and advantages are merely exemplary and are not to be construed as limiting the present invention. The present teaching can be readily applied to other types of apparatuses. Also, descriptions of embodiments of the present invention are intended to be illustrative, and not to limit the scope of the claims, and many alternatives, modifications, and variations will be apparent to those skilled in the art.

What is claimed is:

1. A wet-type image forming apparatus, comprising:

a counter for counting a number of dots of input print data;

a memory for storing an average coverage of a print medium which corresponds to a predetermined dot number of print data, and for storing a lookup table comprising consumption quantities of carrier and toner which correspond to the average coverage; and a control unit for calculating a remaining toner concentration of a developer in a developer supplying unit by using consumption quantities of the carrier and toner that are stored in the memory based on the counted dot number and controlling the remaining toner concentration by selectively consuming at least one of the carrier and the toner.

2. The wet-type image forming apparatus as recited in claim 1, wherein the memory is configured to store a reference toner concentration for comparison with the toner concentration calculated by the control unit.

3. The wet-type image forming apparatus as recited in claim 2, further comprising:

a developer for developing the input print data; and a transferring unit for receiving an image formed in the developing unit, wherein the control unit is configured to compare the calculated toner concentration with the reference toner concentration and control at least one of the developing unit and the transferring unit to selectively consume at least one of the carrier and the toner based on the comparison result.

4. The wet-type image forming apparatus as recited in claim 3, wherein the developing unit comprises:

an organic photoconductor on which an image is formed;

a laser scanning unit for forming an electrostatic latent image by scanning the organic photoconductor with a laser beam, wherein the laser scanning unit is selectively driven by the control unit;

a developing member which selectively receives a voltage from the control unit and supplies the developer to the organic photoconductor when the developing member receives the voltage; and a developer supplying member which selectively receives a voltage from the control unit and supplies the developer to the developing member when receiving the voltage.

5. The wet-type image forming apparatus as recited in claim 4, wherein the control unit is configured to lower the toner concentration of the developer supplying unit by controlling at least one of the operation of the laser scanning unit, the voltage supply to the developing member, and the voltage supply to the developer supplying member.

6. The wet-type image forming apparatus as recited in claim 3, wherein the transferring unit comprises:

an intermediate transfer medium for receiving the image formed in the developing unit; and a transfer roller which supports the intermediate transfer medium and transfers the image of the developing unit to the intermediate transfer medium when the transfer roller receives a predetermined voltage.

7. A method for sensing concentration of toner in a wet-type image forming apparatus, comprising the steps of:

a) acquiring consumption quantities of toner and carrier based on input print data; and b) calculating a toner concentration of a remaining developer based on the consumption quantities of at least one of the toner and the carrier and controlling the toner concentration of the remaining developer by selectively consuming at least one of the carrier and the toner based on said calculation.

8. The method as recited in claim 7, wherein the step a) comprises the steps of:

a1) preparing a lookup table comprising an average coverage corresponding to a predetermined number of dots, and consumption quantities of the toner and the carrier corresponding to the average coverage;

a2) counting the number of dots of the input print data; and a3) acquiring the consumption quantities of the toner and the carrier corresponding to the counted dot number based on the stored lookup table.

9. The method as recited in claim 8, wherein the step a) further comprises a step of:

a4) upgrading data of the lookup table based on the input print data.

10. The method as recited in claim 9, wherein the step a4) comprises the steps of:

a4-1) accumulating consumption quantities of the toner and the carrier acquired in each printing operation; and a4-2) storing the accumulated consumption quantities of the toner and the carrier in a memory.

11. A method for controlling a wet-type image forming apparatus, comprising the steps of:

a) sensing toner concentration of a developer based on the number of dots of input print data;

b) comparing the sensed toner concentration with a reference toner concentration; and c) controlling the sensed toner concentration to maintain a level substantially equal to a reference toner concentration based on the comparison result, wherein the step c) of controlling the sensed toner concentration comprises:

c1) determining if the sensed toner concentration is higher than the reference toner concentration and lowering the toner concentration by selectively consuming the toner if the sensed toner concentration is higher than the reference toner concentration; and c2) determining if the sensed toner concentration is lower than the reference toner concentration and raising the toner concentration by selectively consuming the carrier if the sensed toner concentration is lower than the reference toner concentration.

12. The method as recited in claim 11, wherein the step a) comprises the steps of:

a1) acquiring consumption quantities of toner and carrier based on the number of dots of input print data; and a2) calculating the toner concentration of a remaining developer based on the consumption quantities of the toner and the carrier.

13. The method as recited in claim 12, wherein the step a1) comprises the steps of:

a1-1) preparing a lookup table comprising an average coverage corresponding to a predetermined number of dots, and consumption quantities of the toner and the carrier corresponding to the average coverage;

a1-2) counting the number of dots of the input print data; and a1-3) acquiring the consumption quantities of the toner and the carrier corresponding to the counted dot number based on the stored lookup table.

14. The method as recited in claim 13, wherein the step a1) further comprises a step of:

a1-4) upgrading data of the lookup table based on the input print data.

15. The method as recited in claim 14, wherein the step a1-4) comprises the steps of:

a1-41) accumulating consumption quantities of the toner and the carrier acquired in each printing operation; and a1-42) storing the accumulated consumption quantities of the toner and the carrier in a memory.

16. The method as recited in claim 11, wherein the step c1) comprises the steps of:

c1-1) forming an image for consuming the toner on an organic photoconductor;

c1-2) transferring the image for consuming the toner to a transferring unit; and c1-3) removing the image for consuming the toner which is transferred to the transferring unit through cleaning.

17. The method as recited in claim 16, wherein the step c1-1) comprises the steps of:

c1-11) calculating a quantity of the toner to be consumed;

c1-12) driving a driving motor;

c1-13) forming an electrostatic latent image on the organic photoconductor to correspond to the calculated toner quantity by driving a laser scanning unit; and c1-14) developing the toner in the electrostatic latent image area by selectively supplying predetermined voltages to a developer supplying member and a developing member for a predetermined time.

18. The method as recited in claim 17, wherein the quantity of the toner to be consumed is determined from a lookup table comprising at least one value pre-established through experiment.

19. The method as recited in claim 16, wherein the transferring unit comprises an intermediate transfer medium and a T1 roller which supports the intermediate transfer medium at a side opposite to the organic photoconductor, and wherein the step c1-2) comprises the steps of:

c1-21) driving the intermediate transfer medium; and c1-22) supplying a predetermined voltage to the T1 roller for a predetermined time.

20. The method as recited in claim 16, wherein the image for consuming the toner is formed in a predetermined pattern to correct at least one of an image color and registration.

21. The method as recited in claim 11, wherein the step c2) comprises the steps of:

c2-1) supplying the carrier to the surface of the organic photoconductor;

c2-2) transferring the carrier supplied to the organic photoconductor to a transferring unit; and c2-3) removing the carrier transferred to the transferring unit through cleaning.

22. The method as recited in claim 21, wherein the step c2-1) comprises the steps of:

c2-11) calculating a quantity of the carrier to be consumed;

c2-12) driving the driving motor of the developing unit; and c2-13) transferring the carrier to the organic photoconductor by selectively supplying a predetermined voltage to the developer supplying member and the developing member.

23. The method as recited in claim 22, wherein the supply quantity of the carrier is adjusted by selectively controlling the power and supply time of the voltage supplied to the individual developer supplying member and the developing member while transferring the carrier to the organic photoconductor.

24. The method as recited in claim 21, wherein the transferring unit comprises an intermediate transfer medium in contact with the organic photoconductor and comprises a T1 roller supporting the intermediate transfer medium at a side opposite to the organic photoconductor, and wherein the step c2-2) comprises the steps of:

c2-21) driving the intermediate transfer medium; and c2-22) transferring primarily the carrier on the surface of the organic photoconductor to the intermediate transfer medium by suspending a voltage supply to the T1 roller.

25. The method as recited in claim 11, wherein the step c) is carried out in at least any one step of a warming-up mode, a printing mode, and a transferring unit cleaning mode after the printing mode.

* * * * *